US010679579B2

(12) United States Patent
Cho

(10) Patent No.: US 10,679,579 B2
(45) Date of Patent: Jun. 9, 2020

(54) DATA DRIVING CIRCUIT OF FLAT PANEL DISPLAY DEVICE

(71) Applicant: LG Display Co., Ltd., Seoul (KR)

(72) Inventor: Chang-Hun Cho, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/804,670

(22) Filed: Nov. 6, 2017

(65) Prior Publication Data

US 2018/0144706 A1 May 24, 2018

(30) Foreign Application Priority Data

Nov. 21, 2016 (KR) ..... 10-2016-0154918

(51) Int. Cl.
*G09G 3/36* (2006.01)
*G09G 3/20* (2006.01)

(52) U.S. Cl.
CPC ..... *G09G 3/3688* (2013.01); *G09G 3/2081* (2013.01); *G09G 3/2096* (2013.01); *G09G 3/3607* (2013.01); *G09G 2310/027* (2013.01); *G09G 2310/0286* (2013.01); *G09G 2310/0291* (2013.01); *G09G 2310/0297* (2013.01); *G09G 2310/08* (2013.01)

(58) Field of Classification Search
CPC ..... G09G 3/3688; G09G 2310/027; G09G 3/3614
See application file for complete search history.

(56) References Cited

U.S. PATENT DOCUMENTS 6,373,459 B1 * 4/2002 Jeong ..... G09G 3/3688 345/100
6,806,859 B1 10/2004 Kanoh et al.
2004/0119672 A1 * 6/2004 Lee ..... G09G 3/3688 345/87
2004/0125067 A1 * 7/2004 Kim ..... G09G 3/3614 345/98
2005/0117611 A1 * 6/2005 Shin ..... G09G 3/325 370/536
2007/0080913 A1 4/2007 Park et al.
2007/0091031 A1 4/2007 Park et al.
2008/0150859 A1 * 6/2008 Song ..... G09G 3/3648 345/87
2008/0211703 A1 9/2008 Tsuchi
2009/0189880 A1 * 7/2009 Li ..... G09G 3/3688 345/205

(Continued)

FOREIGN PATENT DOCUMENTS

CN 1956043 A 5/2007
CN 103165067 A 6/2013
JP 2013-122596 A 6/2013

*Primary Examiner* — Yuzhen Shen
(74) *Attorney, Agent, or Firm* — Seed Intellectual Property Law Group LLP

(57) ABSTRACT

A data driving circuit of a flat panel display device is disclosed. Digital-to-analog controllers of a digital-to-analog conversion unit and amplifiers of an output amplification unit are configured to be equal in number and a switch array is arranged between the output amplification unit and a pad. Therefore, a settling time can be secured and distortion of a data signal can be prevented by maintaining settling during a next horizontal period and performing overlapping driving.

18 Claims, 7 Drawing Sheets

(56) References Cited

U.S. PATENT DOCUMENTS

| | | | | |
|---|---|---|---|---|
| 2010/0128027 | A1* | 5/2010 | Nakayama | G09G 3/3688 345/214 |
| 2010/0182297 | A1* | 7/2010 | Lan | G09G 3/3614 345/211 |
| 2010/0182349 | A1* | 7/2010 | Miyazaki | G09G 3/3688 345/690 |
| 2015/0145843 | A1* | 5/2015 | Park | G09G 3/20 345/209 |
| 2016/0042695 | A1* | 2/2016 | Park | G09G 3/3614 345/690 |

* cited by examiner

DATA DRIVING CIRCUIT OF FLAT PANEL DISPLAY DEVICE

CROSS-REFERENCE TO RELATED APPLICATION

This application claims the benefit of Korean Patent Application No. 10-2016-0154918, filed Nov. 21, 2016, which is hereby incorporated by reference as if fully set forth herein.

BACKGROUND

Technical Field

The present disclosure relates to a flat panel display device and, more particularly, to a data driving circuit of a flat panel display device for securing a settling time and preventing distortion of a data signal by maintaining settling during a next horizontal period and performing overlapping driving.

Description of the Related Art

Representative flat panel display devices for displaying images using digital data include liquid crystal displays (LCDs) using liquid crystal and organic light-emitting diode (OLED) displays using OLEDs.

FIG. 1 is a block diagram schematically illustrating a general LCD device.

Generally, the LCD includes, as illustrated in FIG. 1, a timing controller 130, a gate driver 140, a data driver 150, a liquid crystal panel 160, and a backlight unit 170.

The timing controller 130 outputs a gate timing control signal GDC for controlling an operating timing of the gate driver 140 and a data timing control signal DDC for controlling an operating timing of the data driver 150. The timing controller 130 supplies a data signal DATA supplied from an image processor to the data driver 150 together with the data timing control signal DDC.

The gate driver 140 sequentially outputs a scan pulse to each gate line GL in response to the gate timing control signal GDC supplied from the timing controller 130. The gate driver 140 may be formed in an integrated circuit (IC) type or a gate-in panel (GIP) type mounted in the liquid crystal panel 160.

The data driver 150 samples and latches the data signal DATA in response to the data timing control signal DDC supplied from the timing controller 130 and converts the sampled and latched data signal DATA into a gamma reference voltage. The data driver 150 inverts and outputs a polarity of a data voltage at a period of one frame. The data driver 150 supplies the data voltage to sub-pixels SP included in the liquid crystal panel 160 through each data line DL. The data driver 150 may be formed in an IC type.

The liquid crystal panel 160 displays images in correspondence to the scan signal supplied from the gate driver 140 and the data voltage supplied from the data driver 150. The liquid crystal panel 160 includes the sup-pixels SP for controlling light provided through the backlight unit 170. One sub-pixel includes a switching transistor, a storage capacitor, and a liquid crystal layer. A gate electrode of the switching transistor is connected to the gate line GL and a source electrode of the switching transistor is connected to the data line DL. The storage capacitor is formed between a pixel electrode connected to a drain electrode of the switching transistor and a common electrode connected to a common voltage line. That is, the liquid crystal layer is formed between the pixel electrode connected to the drain electrode of the switching transistor and the common electrode connected to the common voltage line.

The liquid crystal panel 160 is implemented in a twisted nematic (TN) mode, a vertical alignment (VA) mode, an in-plane switching (IPS) mode, a fringe field switching (FFS) mode, or an electrically controlled birefringence (ECB) mode, according to the structure of the pixel electrode and the common electrode.

The liquid crystal panel 160 may be implemented by red, green, and blue sub-pixels or may be implemented by white sub-pixels in addition to the red, green, and blue sub-pixels in order to reduce current consumption.

The backlight unit 170 provides light to the liquid crystal panel 160 using a light source that emits light.

Now, the data driver 150 will be described in more detail.

FIG. 2 is a block diagram schematically illustrating an internal configuration of a general data driver.

The data driver includes, as illustrated in FIG. 2, a shift register SR, a first latch LAT1, a second latch LAT2, a digital-to-analog (DA) conversion unit DAC, a switch array 143, and an output amplification unit 145.

The data driver converts a digital data signal into an analog data voltage and outputs the analog data voltage through output channels thereof CH1 to CHN according to operations of the shift register SR, the first and second latches LAT1 and LAT2, the DA conversion unit DAC, the switch array 143, and the output amplification unit 145. Hereinafter, the configuration included in the data driver will be described in brief.

The shift register SR outputs a sampling signal in response to a source start pulse and a source sampling clock supplied from the timing controller 130. The first and second latches LAT1 and LAT2 sequentially sample the digital data signal in response to the sampling signal output from the shift register SR and simultaneously output data signals corresponding to one sampled line in response to a source output enable signal SOE. The source output enable signal SOE may be supplied from the timing controller 130.

The DA conversion unit DAC converts the data signals corresponding to one line into analog data voltages in response to first to n-th gamma gray voltages output from a gamma voltage generator (not shown).

The switch array 143 alternately outputs data voltages of two neighbor digital-to-analog converters (DACs) of the DA conversion unit DAC.

The output amplification unit 145 is located at the rear side of the switch array 143 and amplifies the data voltages output from the switch array 143.

A detailed configuration of the DA conversion unit DAC, the switch array 143, and the output amplification unit 145 will now be described.

FIG. 3 illustrates a detailed configuration of the DA conversion unit DAC, the switch array 143, and the output amplification unit 145 in the general data driver.

The DA conversion unit DAC includes as a plurality of DACs as channels. That is, if there are 3600 channels, the DA conversion unit DAC includes 3600 DACs DAC1 to DAC3600.

The switch array 143 performs a switching operation such that data voltages of odd-numbered DACs and even-numbered DACs among the plurality of DACs DAC1 to DAC3600 are alternatively output.

The output amplification unit 145 includes a plurality of amplifiers AMP1 to AMP1800 corresponding to half of the number of channels. That is, if there are 3600 channels, the output amplification unit 145 includes 1800 amplifiers AMP1 to AMP1800. The amplifiers AMP1 to AMP1800 amplify and output a data voltage output from each pair of DACs corresponding to two adjacent DACs among the plurality of DACs.

However, such a conventional data driving circuit has the following problems.

FIG. 4 is a schematic diagram and corresponding waveform diagram referred to for explaining problems of a conventional data driving circuit.

That is, as can be seen from FIG. 4, in order to implement superior charging characteristics even in a short one-horizontal period, since the charging characteristics is influenced by the delay of the DA conversion unit DAC, and since a fast slew rate should be secured only by one amplifier during the short one-horizontal period, it is difficult to guarantee a settling time.

In more detail, in the conventional data driving circuit, when a one-horizontal period is 2.7 μs, a settling time reaching 99.3% of a target voltage is 2.11 μs. Therefore, the data driving circuit has a difficulty in securing the settling time.

In addition, since the switch array 143 is located between the DA conversion unit DAC and the output amplification unit 145, ripples are generated in an output signal of the DA conversion unit DAC and an output signal of the output amplification unit 145, thereby causing distortion of data signals.

BRIEF SUMMARY

Accordingly, the present disclosure is directed to a data driving circuit of a flat panel display device that substantially obviates one or more problems due to limitations and disadvantages of the related art.

An object of the present disclosure is to provide a data driving circuit of a flat panel display device, for maintaining settling during a next horizontal period, securing a settling time through overlapping driving, and preventing distortion of a data signal, by configuring DACs of a DA conversion unit and amplifiers of an output amplification unit to be equal in number and configuring a switch array between the output amplification unit and a pad.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a data driving circuit of a flat panel display device includes a shift register configured to output a sampling signal in response to receiving a source start pulse and a source sampling clock from a timing controller, a latch configured to sequentially sample a digital data signal in response to the sampling signal and simultaneously output data signals corresponding to one sampled line in response to receiving a source output enable signal, a digital-to-analog conversion unit including a plurality of digital-to-analog converters, and configured to convert the data signals corresponding to one line into analog data voltages in response to receiving first to n-th gamma gray voltages, an output amplification unit including a plurality of amplifiers, and configured to amplify the analog data voltages, and a switch array configured to alternately output data voltages of two adjacent amplifiers of the output amplification unit such that the data voltages of two adjacent amplifiers of the output amplification unit are supplied to one pad.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

A data driving circuit of a flat panel display device according to the present disclosure will now be described in detail with reference to the accompanying drawings. Wherever possible, the same reference numbers will be used throughout the drawings to refer to the same or like parts.

Figure 1:
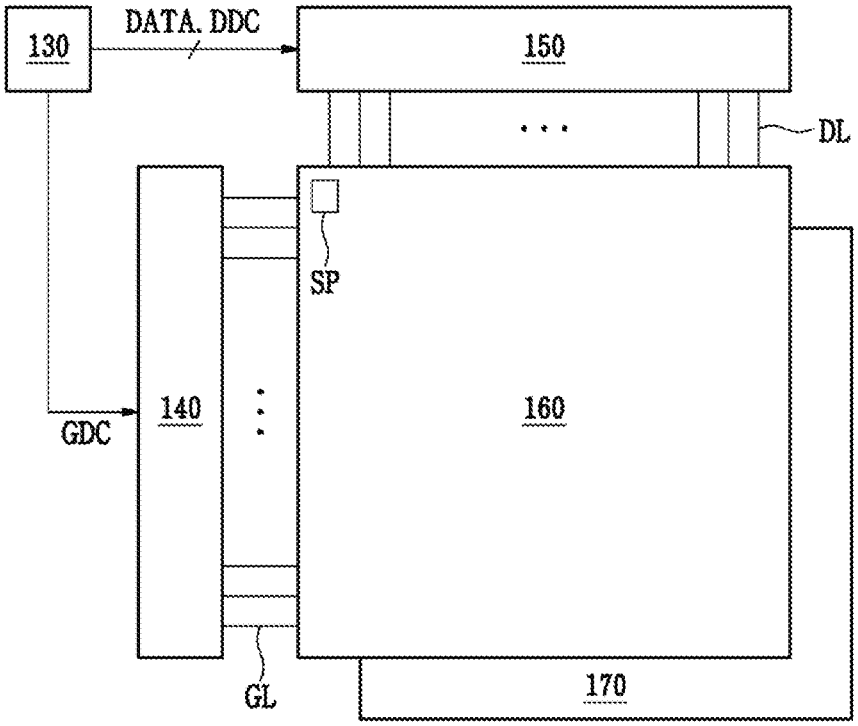
FIG. 1 Prior Art
FIG. 1 is a block diagram schematically illustrating a general LCD device.
Figure 2:
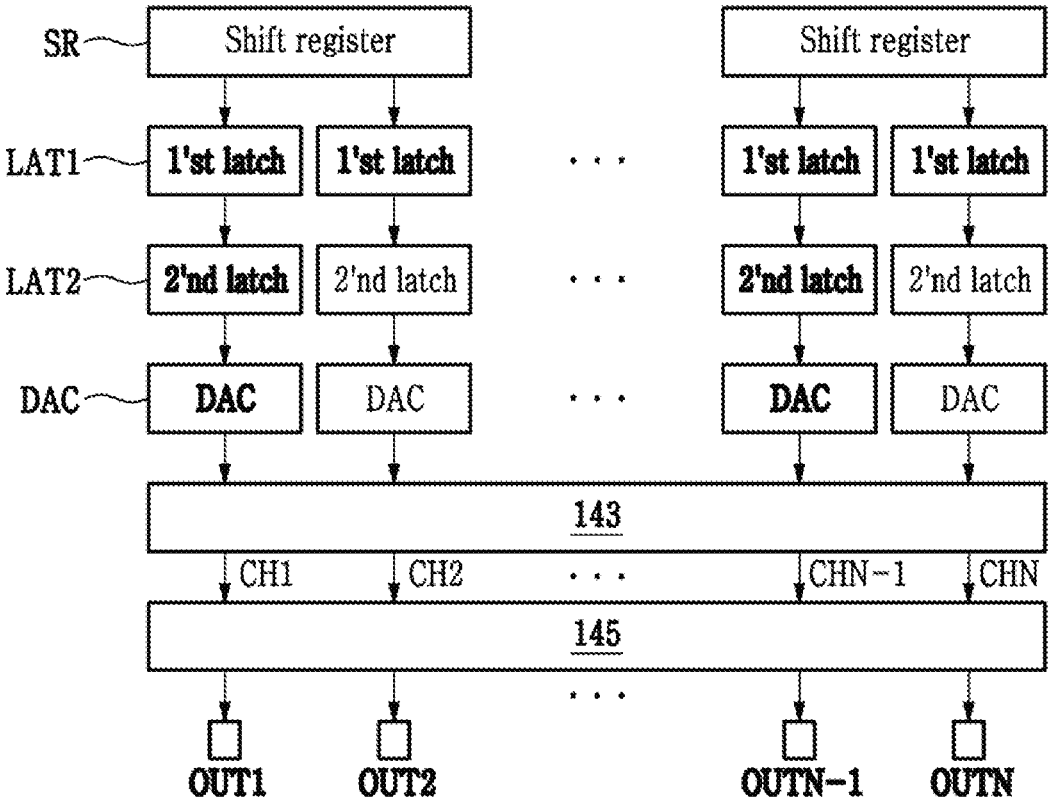
FIG. 2 Prior Art
FIG. 2 is a block diagram schematically illustrating an internal configuration of a general data driver.
Figure 3:
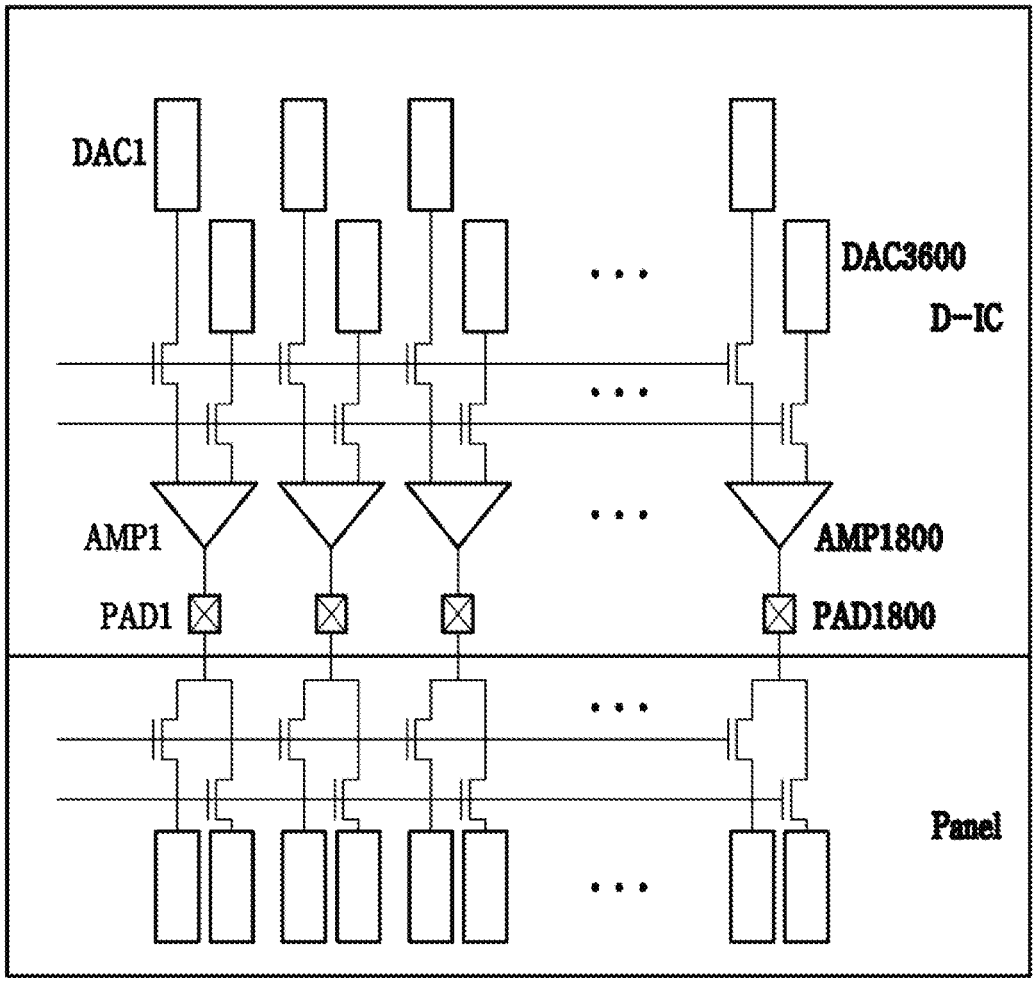
FIG. 3 Prior Art
FIG. 3 is a schematic diagram illustrating a detailed configuration of a digital-to-analog converter, a switch array, and an output amplifier of FIG. 2.
Figure 4:
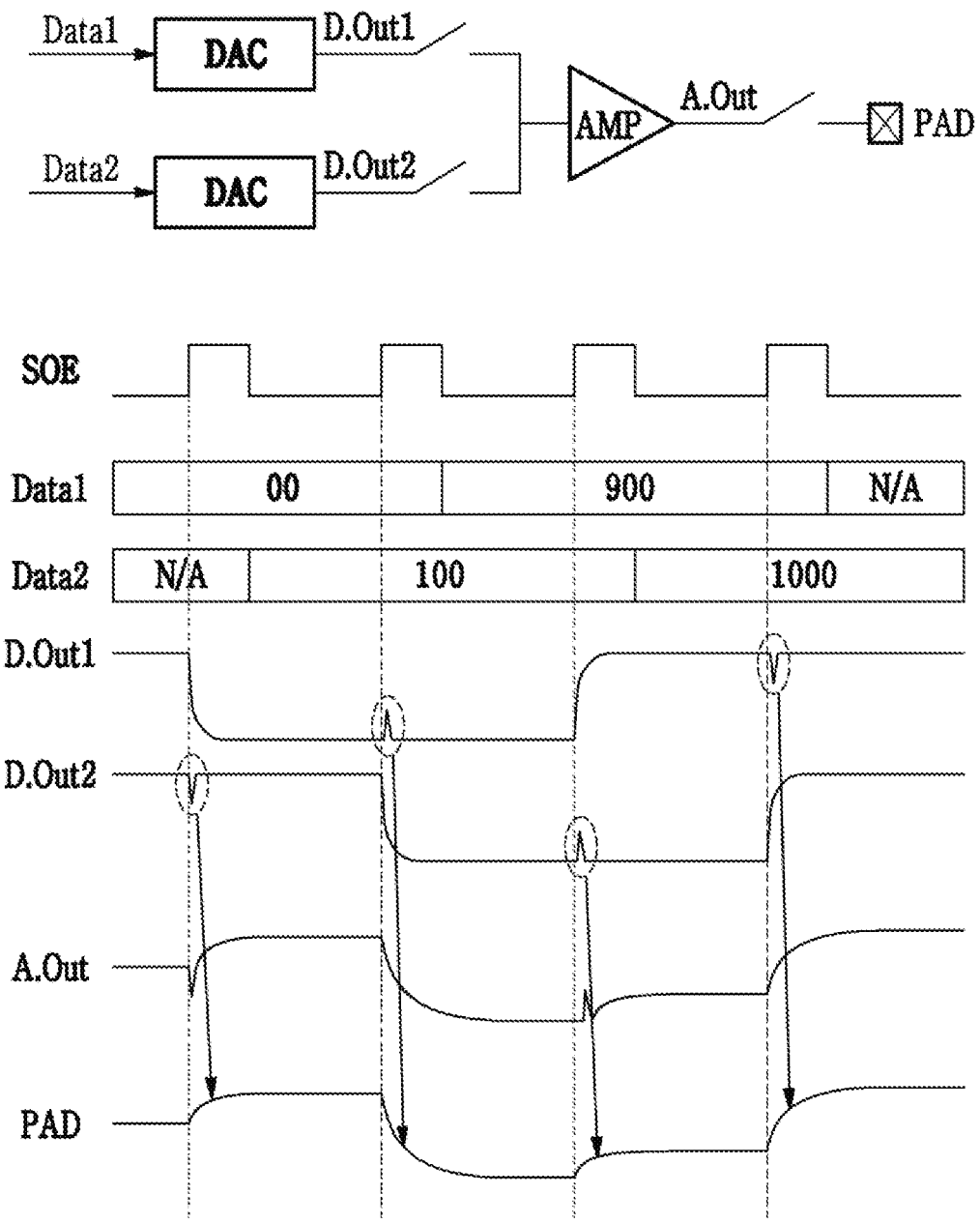
FIG. 4 Prior Art
FIG. 4 is a schematic diagram and corresponding waveform diagram referred to for explaining problems of a conventional driving circuit.

A flat panel display device according to the present disclosure includes, as illustrated in FIG. 1, a timing controller, a gate driver, a data driver, and a flat panel. That is, the flat panel display device according to various embodiments of the present disclosure may generally include the same arrangement of components as shown in FIG. 1; however, there are particular differences in the details of these components, as will be discussed below. Thus, FIG. 1 is referred to in the description of the embodiments of the present disclosure only to show, in general, the arrangement of the timing controller, gate driver, data driver, and flat panel of the present disclosure. In particular, the data driver of the embodiments of the present disclosure is different from the data driver shown in FIG. 1, as will be discussed in further detail below.

The timing controller outputs a gate timing control signal for controlling an operating timing of the gate driver and a data timing control signal for controlling an operating timing of the data driver. The timing controller supplies a data signal DATA supplied from an image processor to the data driver together with the data timing control signal.

The gate driver sequentially outputs a scan pulse to each gate line GL in response to the gate timing control signal supplied from the timing controller.

The data driver samples and latches the data signal DATA in response to the data timing control signal supplied from the timing controller and converts the sampled and latched data signal into a gamma reference voltage. The data driver supplies the data voltage to sub-pixels SP included in the flat panel through each data line DL.

The flat panel displays images in response to the scan signal supplied from the gate driver and the data voltage supplied from the data driver.

The flat panel includes a liquid crystal panel or an OLED panel.

A configuration of the data driver according to the present disclosure will now be described in more detail.

Figure 5:
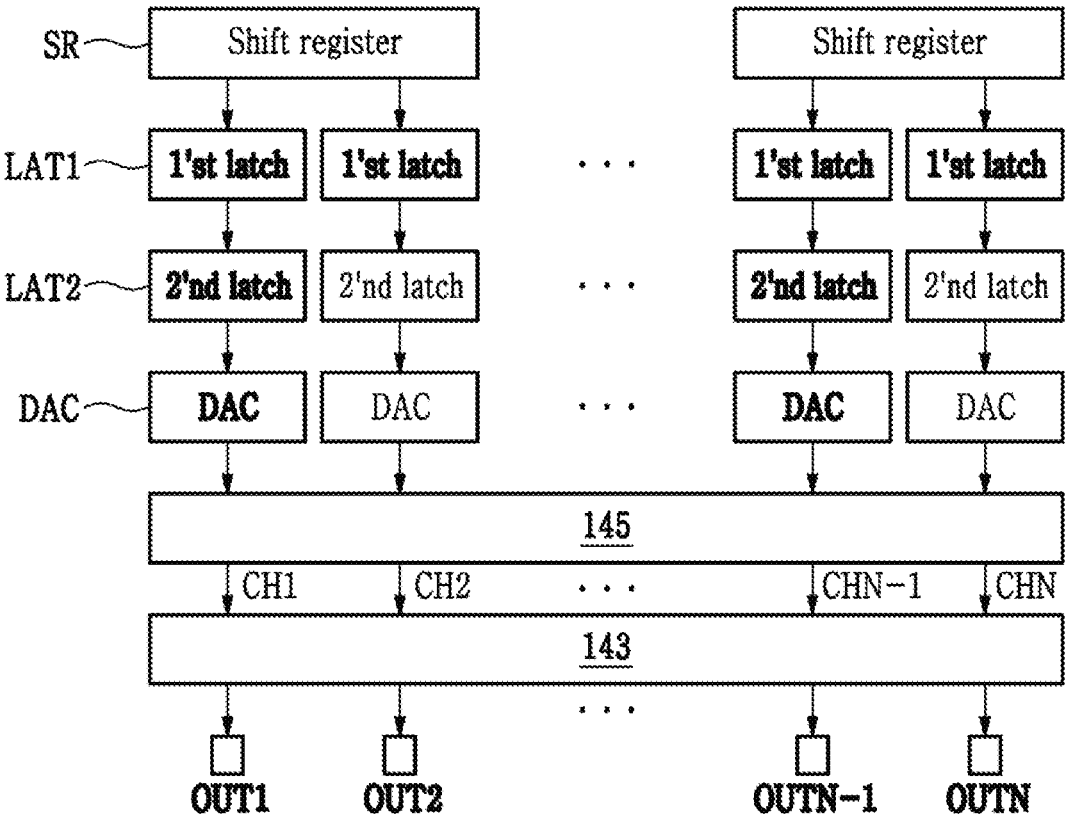
FIG. 5 is a block diagram schematically illustrating an internal configuration of a data driver according to the present disclosure.

FIG. 5 is a block diagram schematically illustrating an internal configuration of a data driver according to an embodiment of the present disclosure.

The data driver according to an embodiment of the present disclosure includes, as illustrated in FIG. 5, a shift register SR, a first latch LAT1, a second latch LAT2, a DA conversion unit DAC, an output amplification unit 145, and a switch array 143.

The shift register SR outputs a sampling signal in response to a source start pulse and a source sampling clock supplied from the timing controller. The first and second latches LAT1 and LAT2 sequentially sample a digital data signal in response to the sampling signal output from the shift register SR and simultaneously output data signals corresponding to one sampled line in response to a source output enable signal SOE.

The DA conversion unit DAC converts the data signals corresponding to one line into analog data voltages in response to first to n-th gamma gray voltages output from a gamma voltage generator (not shown).

The output amplification unit 145 is located at the rear side of the DA conversion unit DAC and amplifies and outputs the data voltages output from the DA conversion unit DAC. The output amplification unit 145 is coupled between the DA conversion unit DAC and the switch array 143, as shown in FIG. 5. Accordingly, the output amplification unit 145 receives the data voltages from the DA conversion unit DAC, amplifies the data voltages, and outputs the amplified data voltages to the switch array 143.

The switch array 143 alternately outputs data voltages of the odd-numbered amplifiers AMP1, AMP3, . . . AMP3599 and data voltages of the even-numbered amplifiers AMP2, AMP4, . . . AMP3600 among the plurality of amplifiers AMP1 to AMP3600 of the output amplification unit 145. That is, the switch array 143 alternately outputs data voltages of two adjacent amplifiers of the output amplification unit such that the data voltages of two adjacent amplifiers of the output amplification unit are supplied to one pad.

A detailed configuration of the DA conversion unit DAC, the switch array 143, and the output amplification unit 145 will now be described.

Figure 6:
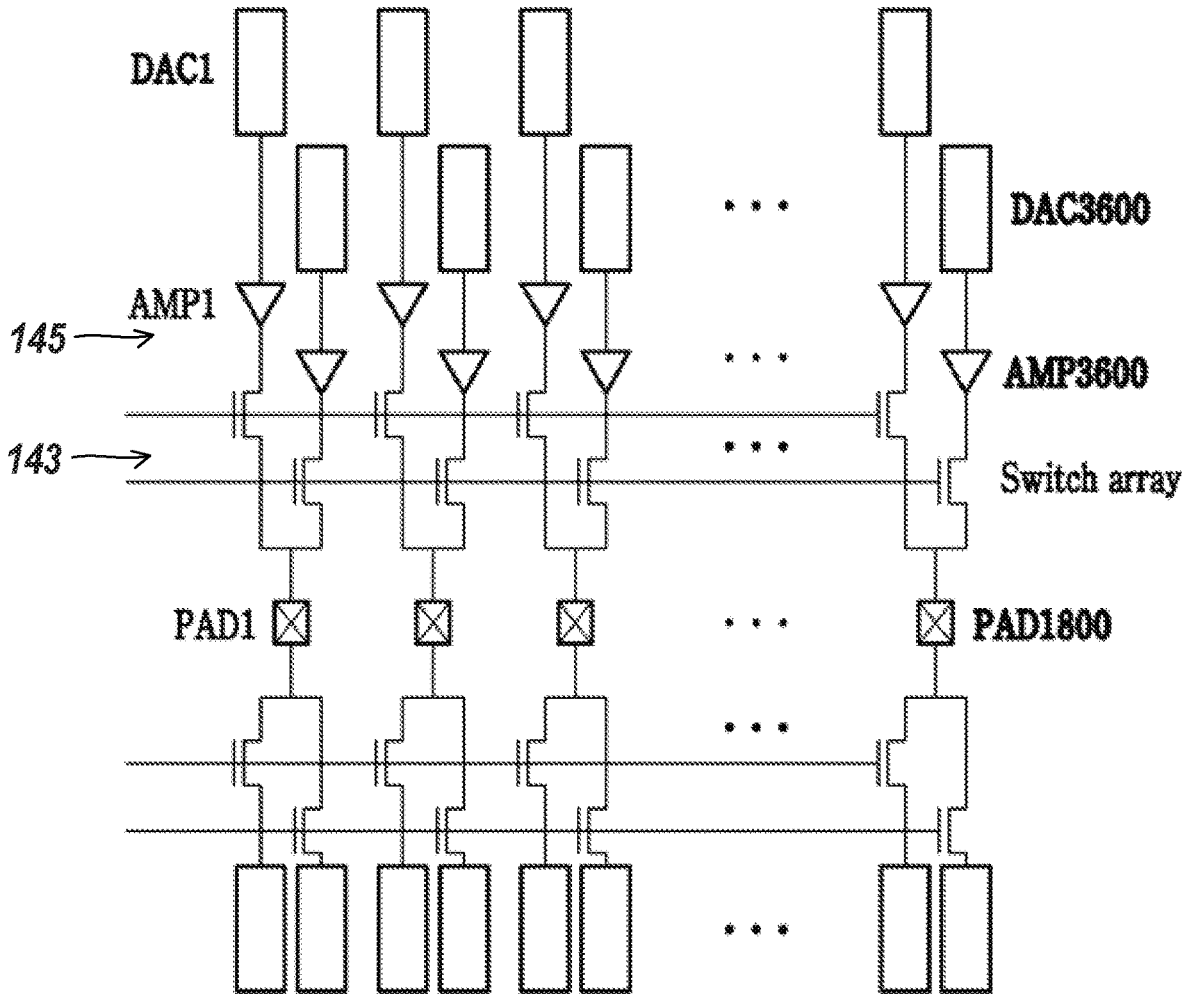
FIG. 6 is a schematic diagram illustrating a detailed configuration of a digital-to-analog converter, an output amplifier, and a switch array according to the present disclosure.

FIG. 6 illustrates a detailed configuration of the DA conversion unit DAC, the output amplification unit 145, and the switch array 143 in the data driver according to the present disclosure.

The DA conversion unit DAC includes a plurality of DACs, which may be the same in number as the number of channels such that each DAC corresponds to a respective channel. The output amplification unit 145 also includes a plurality of amplifiers AMP1 to AMP3600, which may be the same in number as the number of channels, with each of the amplifiers corresponding to a respective channel.

That is, if there are 3600 channels, the DA conversion unit DAC and the output amplification unit 145 include 3600 DACs DAC1 to DAC3600 and 3600 amplifiers AMP1 to AMP3600, respectively.

The switch array 143 alternately outputs data voltages of odd-numbered amplifiers AMP1, AMP3, AMP5, . . . , and data voltages of even-numbered amplifiers AMP2, AMP4, AMP6, . . . , among the amplifiers AMP1 to AMP 3600 such that the data voltages of the two adjacent amplifiers among the amplifiers AMP1 to AMP 3600 are supplied to one pad among pads PAD1 to PAD1800.

Figure 7:
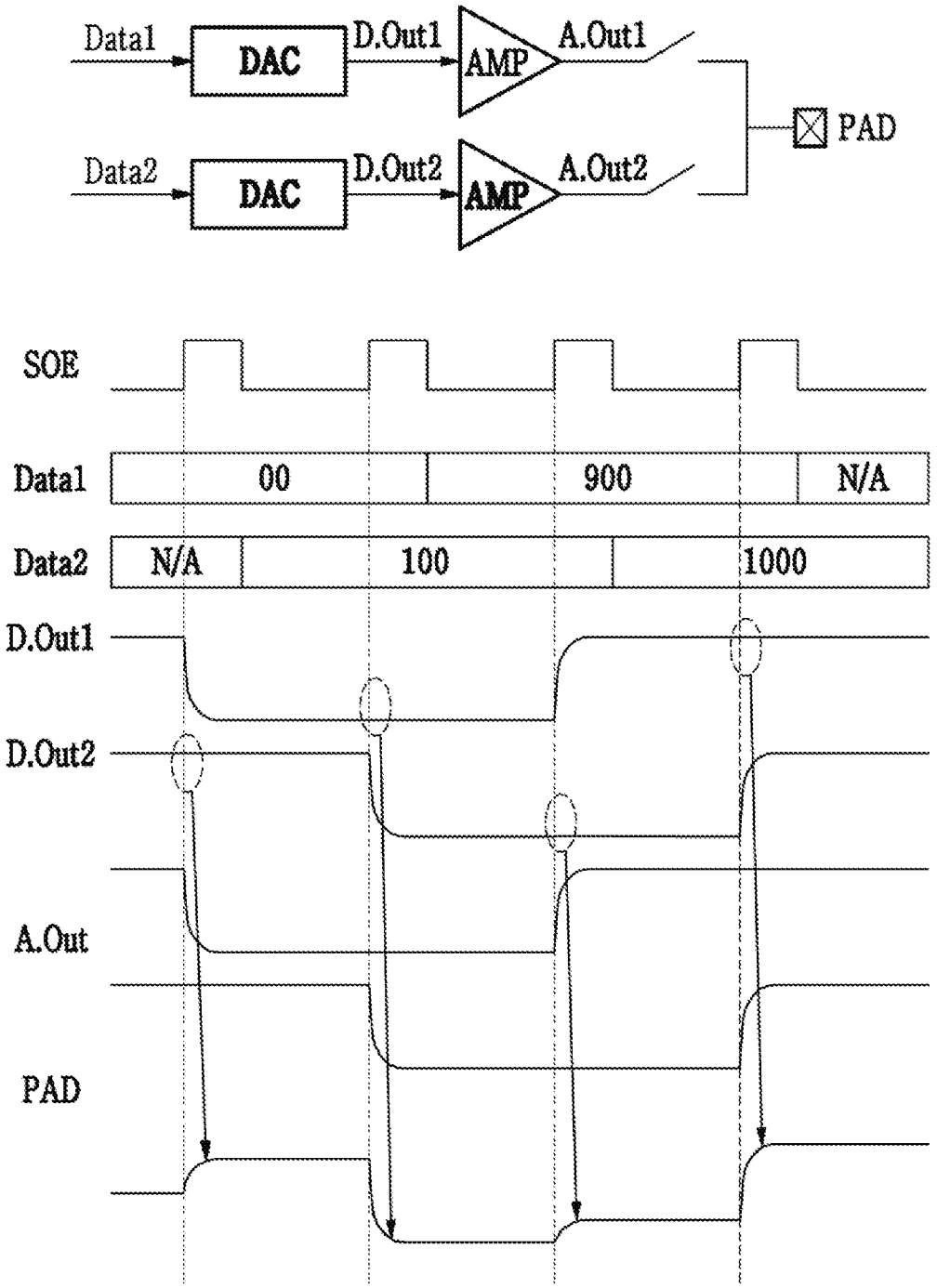
FIG. 7 is a schematic diagram and corresponding waveform diagram of an output of a data driving circuit according to the present disclosure.

FIG. 7 is a schematic diagram and corresponding waveform diagram of an output of a data driving circuit according to the present disclosure.

Since the switch array 143 is not located between the DA conversion unit DAC and the output amplification unit 145, ripples are not generated in an output signal of the DA conversion unit DAC and an output signal of the output amplification unit 145.

In addition, in the data driving circuit according to the present disclosure, settling is maintained during a next horizontal period and overlapping is maintained in outputs of two adjacent amplifiers. Accordingly, since a settling time reaching 99.3% of a target voltage is 0.97 μs when one horizontal period is 2.7 μs, the settling time can be sufficiently secured.

The data driving circuit of the flat panel display device configured as described above according to the present disclosure has the following effects.

A display device of a virtual reality (VR) model requires a fast settling time within a short 1-horizontal (1H) period. According to the present disclosure, the number of DACs of the DA conversion unit is equal to the number of amplifiers of the output amplification unit and the switch array is arranged between the output amplification unit and the pad. Therefore, since settling is maintained during a next horizontal period and overlapping driving is performed, a settling time can be sufficiently secured within a short 1H period and distortion of a data signal can be prevented.

It will be apparent to those skilled in the art that various modifications and variations can be made in the present disclosure without departing from the spirit or scope of the disclosure. Thus, the present disclosure is intended to cover the modifications and variations of this disclosure within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A data driving circuit of a flat panel display device, comprising:

a shift register configured to output a sampling signal in response to receiving a source start pulse and a source sampling clock from a timing controller;

a latch configured to sequentially sample a digital data signal in response to the sampling signal and output data signals corresponding to one sampled line in response to receiving a source output enable signal;

a digital-to-analog conversion unit including a plurality of digital-to-analog converters, and configured to convert the data signals corresponding to one line into analog data voltages in response to receiving first to n-th gamma gray voltages;

an output amplification unit including a plurality of amplifiers, and configured to amplify the analog data voltages, the plurality of amplifiers being equal in number to a number of channels of the data driving circuit, each of the amplifiers having an input directly electrically connected to an output of a respective one of the plurality of digital-to-analog converters; and a switch array configured to alternately output data voltages of the output amplification unit such that the data voltages of two adjacent amplifiers of the output amplification unit are supplied to only one pad.

2. The data driving circuit according to claim 1, wherein the digital-to-analog conversion unit includes a number of digital-to-analog converters that is equal to the number of channels of the data driving circuit.

3. The data driving circuit according to claim 1, wherein the switch array performs a switching operation such that data voltages of odd-numbered amplifiers and data voltages of even-numbered amplifiers among the plurality of amplifiers are alternately output.

4. The data driving circuit of claim 1 wherein each of the plurality of amplifiers is configured to receive analog data voltages from only one of the plurality of digital-to-analog converters.

5. The data driving circuit of claim 1 wherein each of the plurality of amplifiers is directly electrically connected to the output of the respective digital-to-analog converter.

6. The data driving circuit of claim 1 wherein each of the plurality of amplifiers is directly electrically connected between the output of the respective one of the plurality of digital-to-analog converters and only one switch of the switch array.

7. The data driving circuit of claim 1 wherein the two adjacent amplifiers of the output amplification unit have outputs that overlap one another.

8. The data driving circuit according to claim 1, wherein the switch array performs a switching operation such that data voltages of odd-numbered amplifiers and data voltages of even-numbered amplifiers among the plurality of amplifiers are alternately output.

9. A device, comprising:

a display panel;

a timing controller coupled to the display panel; and a data driver coupled to the timing controller and the display panel, the data driver including:

a shift register;

a latch coupled to an output of the shift register;

a digital-to-analog conversion unit coupled to an output of the latch, the digital-to-analog conversion unit including a plurality of digital-to-analog converters;

an output amplification unit including a plurality of amplifiers, each of the amplifiers being directly electrically connected to an output of a respective digital-to-analog converter, the plurality of amplifiers being equal in number to a number of channels of the display panel; and a switch array including a plurality of switches, the switch array alternately outputting data voltages of the output amplification unit such that data voltages of two adjacent amplifiers of the output amplification unit are supplied to only one pad.

10. The device of claim 9 wherein the plurality of switches of the switch array are arranged in a plurality of pairs of switches, each of the pairs of switches being coupled to a respective pair of the amplifiers and configured to alternately output the data voltages received from each amplifier of the pair of amplifiers.

11. The device of claim 10, further comprising a plurality of pads, each of the pads being coupled to a respective pair of switches.

12. The device of claim 9, wherein the display panel includes a plurality of pads corresponding to ½ of a number of channels of the display panel.

13. The device of claim 12 wherein each of the plurality of amplifiers is configured to receive analog data voltages from only one of the plurality of digital-to-analog converters.

14. The device of claim 12 wherein each of the plurality of amplifiers is directly electrically connected to the output of the respective digital-to-analog converter.

15. The device of claim 12 wherein the digital-to-analog conversion unit includes a number of digital-to-analog converters that is equal to the number of channels of the data driving circuit.

16. The device of claim 9 wherein each of the plurality of amplifiers is directly electrically connected between the output of the respective digital-to-analog converter and only one switch of the switch array.

17. The device of claim 9 wherein the two adjacent amplifiers of the output amplification unit have outputs that overlap one another.

18. A data driving circuit of a flat panel display device, comprising:

a shift register configured to output a sampling signal in response to receiving a source start pulse and a source sampling clock from a timing controller;

a latch configured to sequentially sample a digital data signal in response to the sampling signal and output data signals corresponding to one sampled line in response to receiving a source output enable signal;

a digital-to-analog conversion unit including a plurality of digital-to-analog converters, and configured to convert the data signals corresponding to one line into analog data voltages in response to receiving first to n-th gamma gray voltages;

an output amplification unit including a plurality of amplifiers, and configured to amplify the analog data voltages, the plurality of amplifiers being equal in number to a number of channels of the data driving circuit; and a switch array configured to alternately output data voltages of the output amplification unit such that the data voltages of two adjacent amplifiers of the output amplification unit are supplied to only one pad, wherein the digital-to-analog conversion unit includes a number of digital-to-analog converters that is equal to the number of channels of the data driving circuit.

* * * * *